US010707006B2

(12) United States Patent
Ettl

(10) Patent No.: US 10,707,006 B2
(45) Date of Patent: Jul. 7, 2020

(54) TRANSFORMER WITH HINGED COOLING MODULE

(71) Applicant: SIEMENS AKTIENGESELLSCHAFT, Munich (DE)

(72) Inventor: Christian Ettl, Weiz (AT)

(73) Assignee: Siemens Aktiengesellschaf, Munich (DE)

( * ) Notice: Subject to any disclaimer, the term of this patent is extended or adjusted under 35 U.S.C. 154(b) by 922 days.

(21) Appl. No.: 15/159,344

(22) Filed: May 19, 2016

(65) Prior Publication Data

US 2017/0316861 A1 Nov. 2, 2017

(30) Foreign Application Priority Data

Apr. 29, 2016 (DE) ..... 10 2016 207 390

(51) Int. Cl.

| | |
|---|---|
| ***H01F 27/10*** | (2006.01) |
| ***H01F 27/08*** | (2006.01) |
| ***H01F 27/02*** | (2006.01) |
| ***H01F 27/12*** | (2006.01) |

(52) U.S. Cl.

CPC ..... *H01F 27/025* (2013.01); *H01F 27/08* (2013.01); *H01F 27/085* (2013.01); *H01F 27/12* (2013.01)

(58) Field of Classification Search

CPC ..... H01F 27/025; H01F 27/08; H01F 27/085; H01F 27/12

USPC ..... 336/58, 55–57, 60, 61

See application file for complete search history.

(56) References Cited

U.S. PATENT DOCUMENTS

| | | | | |
|---|---|---|---|---|
| 1,860,511 | A * | 5/1932 | Nichols | H01F 27/14 174/12 R |
| 3,137,829 | A * | 6/1964 | Dillow | H01F 27/08 336/57 |
| 3,235,823 | A | 2/1966 | Renberg, Jr. | |
| 7,962,250 | B2 | 6/2011 | Bretzner et al. | |
| 9,543,066 | B2 | 1/2017 | Calvert et al. | |
| 2011/0273255 | A1* | 11/2011 | Thompson | H01F 27/02 336/94 |
| 2016/0107795 | A1* | 4/2016 | Brodeur | B65D 25/20 336/58 |

FOREIGN PATENT DOCUMENTS

| | | | |
|---|---|---|---|
| DE | 1119840 | * | 7/1968 |
| DE | 102005060635 | A1 | 6/2007 |
| EP | 2767989 | A1 | 8/2014 |
| EP | 2838092 | A1 | 2/2015 |
| GB | 1119840 | A | 7/1968 |
| JP | 2014045114 | * | 3/2014 |
| WO | 2012143172 | A1 | 10/2012 |
| WO | 2015015369 | A1 | 2/2015 |

* cited by examiner

*Primary Examiner* — Mang Tin Bik Lian
*Assistant Examiner* — Kazi S Hossain
(74) *Attorney, Agent, or Firm* — Laurence Greenberg; Werner Stemer; Ralph Locher

(57) ABSTRACT

An electrical appliance for connection to a high-voltage grid has a housing which can be filled with insulating liquid and in which there is arranged a core with at least one winding. A cooling module for cooling the insulating liquid is connected to the housing via attachment lines. The electrical appliance is inexpensive and can be quickly transported and quickly set in operation on site, in that the novel cooling module is fastened to the housing by way of a hook connection.

13 Claims, 3 Drawing Sheets

TRANSFORMER WITH HINGED COOLING MODULE

BACKGROUND OF THE INVENTION

Field of the Invention

The invention relates to an electrical appliance for connection to a high-voltage grid, having a housing which can be filled with insulating liquid and in which there is arranged a core with at least one winding, and having a cooling module, which is connected to the housing via attachment lines, for cooling the insulating liquid.

An electrical appliance of said type is already known from established practice. For example, transformers have a housing in which there is arranged a core with a yoke and multiple limbs, wherein at least one limb is surrounded by a winding. The structure formed from core and windings is often referred to by a person skilled in the art as "active part". For the insulation of the electrical conductors, the housing of the transformer is filled with an insulating liquid which, aside from the electrical insulation, is also intended to perform cooling of the active part. For this purpose, the insulating liquid that has been heated by the active part is conducted via a cooling module which is connected to the housing. To be able to provide the required cooling power, cooling modules generally take up a lot of space and have a high inherent weight. They are furthermore preferably firmly fixed to the housing.

Furthermore, it has also become known from practice for cooling modules to be arranged on heavy goods vehicles. The heavy goods vehicles are parked in the vicinity of the transformer housing such that the housing can be connected to the one or more cooling modules by way of a hose connection. This however has the disadvantage that the transformer comprising the cooling module and the housing requires an even greater amount of space. Furthermore, the hose connection, which is susceptible to faults, constitutes an environmental protection hazard.

BRIEF SUMMARY OF THE INVENTION

It is therefore an object of the invention to provide an electrical appliance of the type mentioned in the introduction, which electrical appliance is inexpensive and can be quickly transported and quickly set in operation on site.

Said object is achieved by the invention in that the cooling module is fastened to the housing by way of a hook-type connection.

According to the invention, in order to set a transformer or a choke coil as electrical appliance in operation, the cooling module is hooked onto the housing. This makes it possible for the cooling module to be fastened to the housing by way of one crane movement. In the context of the invention, no screw connections are necessary. Owing to the hook-type connection in interaction with the high inherent weight of the cooling module, the electrical appliance according to the invention withstands the mechanical demands during operation. For the connection of the interior of the cooling module to the interior of the housing, an expedient connection, for example a pipe connection, is provided in the context of the invention.

The hook-type connection advantageously has a hook part, which is fixedly connected to the cooling module, and a counterpart, which is fixedly arranged on the housing, wherein the hook part and the counterpart are designed such that engagement of the hook part with the counterpart is made possible. The hook part engages, for example by way of a hook-shaped end piece, behind the counterpart, wherein the weight of the cooling module pushes the hook-shaped end piece against the counterpart.

The housing advantageously has a cover, wherein the counterpart is arranged on the cover. In this advantageous refinement, the hooking-on process by way of a crane in the context of the invention is simplified yet further, because the counterpart, which is arranged on the housing cover, is easily accessible. The setting of the electrical appliance in operation is thus expedited yet further.

In a refinement which is expedient in this regard, two counterparts are provided so as to be equally spaced apart from an edge of the housing. In this embodiment of the invention, two hook-type connections are provided which are of identical design to one another, giving rise to symmetrical support of the cooling module on the housing.

The hook part preferably has a carrier which extends in a longitudinal direction and which has a free end which is bent in a C shape, and the counterpart is designed as a holding bolt which extends parallel to and spaced apart from a wall of the housing. The holding bolt is fixedly attached, for example by welding, to the housing, for example to the housing cover, by way of two limbs which are fixedly connected to the housing, such that a counterpart of upturned U shape is provided, into which the end, which is bent in a C shape, of the hook part can be easily and reliably hooked.

In a preferred embodiment, both the housing and the cooling module each have at least one cooling-liquid inlet and at least one cooling-liquid outlet which are connectable to one another for the exchange of insulating liquid, wherein each cooling-liquid outlet and each cooling-liquid inlet is equipped with a fluid-tight closure valve. In this advantageous refinement, the modules of the electrical appliance, that is to say the housing and the cooling module, can be filled with insulating liquid, and transported, independently of one another. The connection of the two modules is subsequently performed by way of attachments designed expediently for that purpose, for example pipe connections with angle compensators, such that insulating liquid can pass from the housing into the cooling module and vice versa. The closure valves make it possible for the housing and the cooling module to be closed in fluid-tight fashion. After the connection between cooling module and housing has been produced, the closure valves are opened.

The expression "fluid-tight closure valves" is to be understood to mean that the closure valves are impermeable both to air and to liquids, and thus prevent contamination of the insulating liquid, for example a mineral insulating oil, with moisture or air.

In a preferred embodiment of the invention, an intermediate piece is provided for the fluid-tight connection of cooling-liquid outlet and cooling-liquid inlet, wherein the intermediate piece delimits a connecting duct which is open at both sides, and said intermediate piece has a ventilation opening for the ventilation of the connecting duct. In this embodiment of the invention, the intermediate piece may be ventilated for example by the application of a vacuum to the ventilation opening. Subsequently, the closure valves of the respective cooling-liquid outlet and of the respective cooling-liquid inlet, which are connected to one another via said intermediate piece, are opened. It is self-evidently also possible for the connecting duct to be filled with an expedient gas, for example nitrogen, sulfur hexafluoride or the like, such that no pressure differences arise. It is also possible in the context of the invention for the connecting duct to be handled in some other way.

Further advantages are attained if the cooling module has a holding frame which is equipped with the hook part. Holding frame and cooling module can thus be produced individually and connected to one another after having been produced and tested. The overall construction, which is in this case likewise referred to as cooling module, can thus be hooked, by way of said hook part, into a counterpart fastened to the housing.

Further advantages are attained if the cooling module has a holding frame which is equipped with a lifting engagement portion for the purposes of lifting the holding frame. The lifting engagement portion is for example a closed ring-shaped lifting eyelet which has an internal diameter which allows a conventional crane hook to be hooked in, and which thus permits simple lifting of the holding frame and thus of the cooling module as a whole. In a deviation from this, the lifting engagement portion is likewise of hook-shaped form.

In a refinement which is expedient in this regard, there is fastened to the holding frame an expansion tank which is connected to the interior of the housing via an attachment line. The expansion tank, too, may then be transported as a component separately from the housing.

In one refinement of the invention, the expansion tank has a housing connector for the intake or discharge of insulating liquid, said housing connector being equipped with a fluid-tight closure valve. This applies correspondingly to an expansion tank of the housing, such that independent transport is made possible, wherein both parts or components or modules may be filled with insulating liquid. The connection of the modules may again be realized by way of an intermediate piece which delimits a connecting duct, said connecting duct being open on both sides and being equipped with a ventilation opening and/or with a drainage opening. By way of the drainage opening, insulating liquid can be drained out of the intermediate piece before the dismounting process.

The design of the cooling module is basically arbitrary. It is however advantageous if the cooling module is in the form of an active cooling module and has a fan. The fan increases the cooling power of the active cooling module in relation to a passive cooling module, which is dimensioned correspondingly.

Further expedient refinements and advantages of the invention will be discussed in the following description of exemplary embodiments of the invention with reference to the figures of the drawing, wherein the same reference designations refer to components of identical action, and wherein

DESCRIPTION OF THE INVENTION

Figure 1:
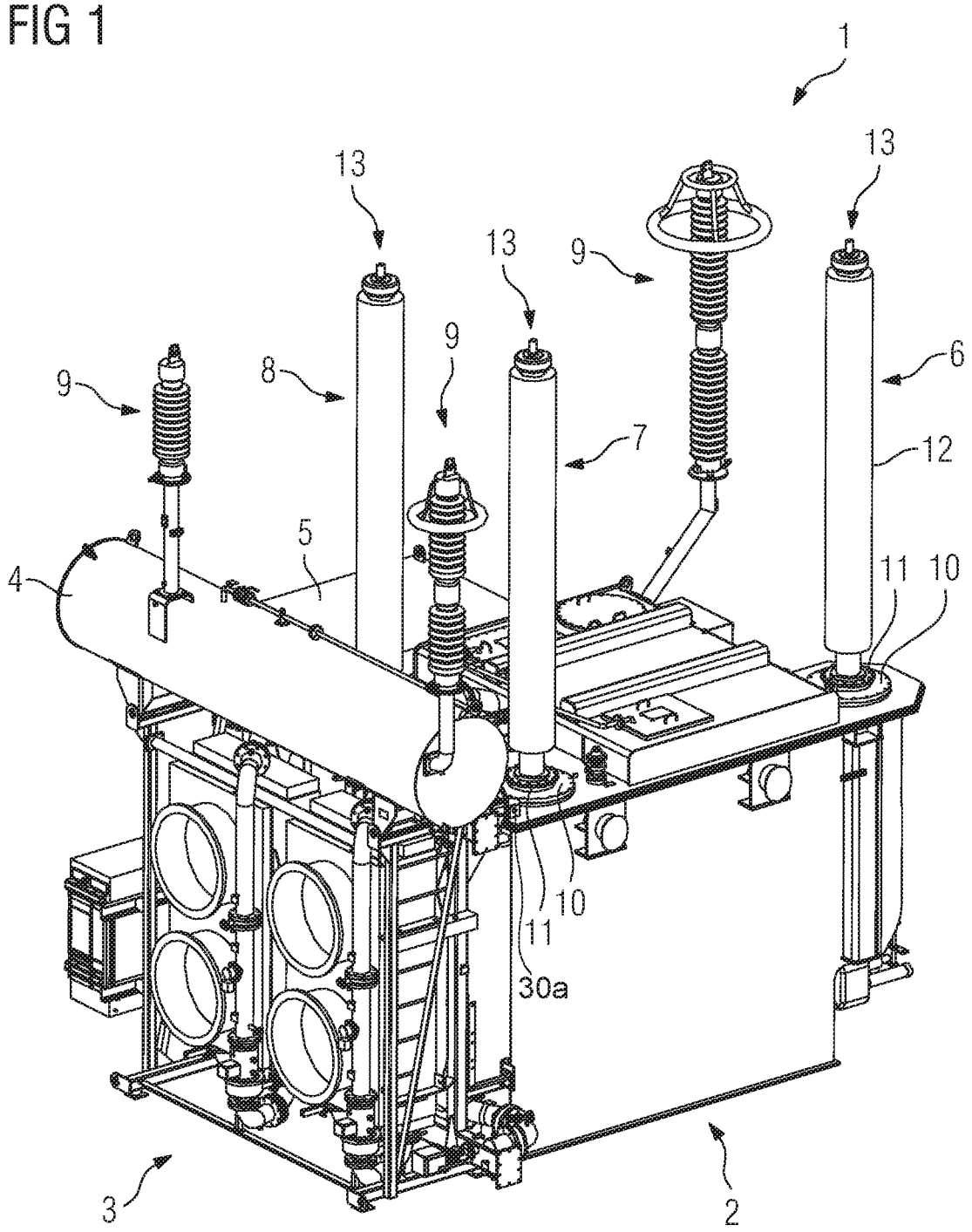
FIG. 1 shows an exemplary embodiment of the electrical appliance according to the invention in a perspective illustration.

FIG. 1 shows, in a perspective view, a single-phase transformer 1 as an exemplary embodiment of an electrical appliance according to the invention. The transformer 1 shown in said figure has a housing 2 which is equipped with a cooling module 3, an expansion tank 4, an auxiliary power module 5 and high-voltage leadthroughs 6, 7, 8. The stated components or modules are detachably connected to one another, and can thus be easily assembled, disassembled and transported independently of one another. For the protection of the high-voltage leadthroughs 6, 7 and 8 and of the active part of the transformer arranged in the housing, that is to say of the higher-voltage winding connected to the high-voltage leadthrough 6 or 7 and of the lower-voltage winding connected to the high-voltage leadthrough 8 and of the core, the limbs of which are surrounded by the respective windings, arresters 9 are provided which, within their arrester housing, have a non-linear resistance which, in the event of overvoltages, changes from a non-conductive state into a conductive state and thus protects the components connected in parallel therewith.

The high-voltage leadthroughs 6, 7 and 8 are each in the form of plug-in high-voltage leadthroughs and can be inserted by way of their plug-in end into matching leadthrough plug-in bushings 10. The leadthrough plug-in bushings 10 are of rotationally symmetrical form and delimit a cavity which is open toward the housing cover but which is closed on one side and which is of complementary shape to the plug-in end of the respective high-voltage leadthrough 6, 7, 8. The leadthrough plug-in bushings 10 are furthermore connected in fluid-tight fashion to the housing 2 such that the interior or oil chamber of the single-phase transformer 1 is closed off in hermetic or fluid-tight, that is to say air-tight and liquid-tight, fashion with respect to the external atmosphere. On the closed end of the leadthrough plug-in bushing 10 there is held a line bolt (not visible in the figures) which, when the high-voltage leadthrough 6, 7 or 8 has been inserted into the respective leadthrough plug-in bushing 10, is in conductive contact with the high-voltage conductor extending through the respective high-voltage leadthrough 6, 7, 8. Said line bolt extends into the interior of the housing 2, that is to say into the oil chamber thereof, where it is in contact with a winding attachment line which thus electrically connects the leadthrough plug-in bushing to the respective higher-voltage or lower-voltage winding of the transformer 1.

For the installation and fixing of the high-voltage leadthrough 6, 7 or 8, these each have a fastening attachment 11. From the fastening attachment 11, a column section 12 extends to a high-voltage terminal 13 which, in the exemplary embodiment shown, is an outdoor terminal. The spacing between the fastening attachment 11 and the high-voltage terminal 13 is, in the exemplary embodiment shown, over 3 meters and in particular 4 meters.

Figure 2:
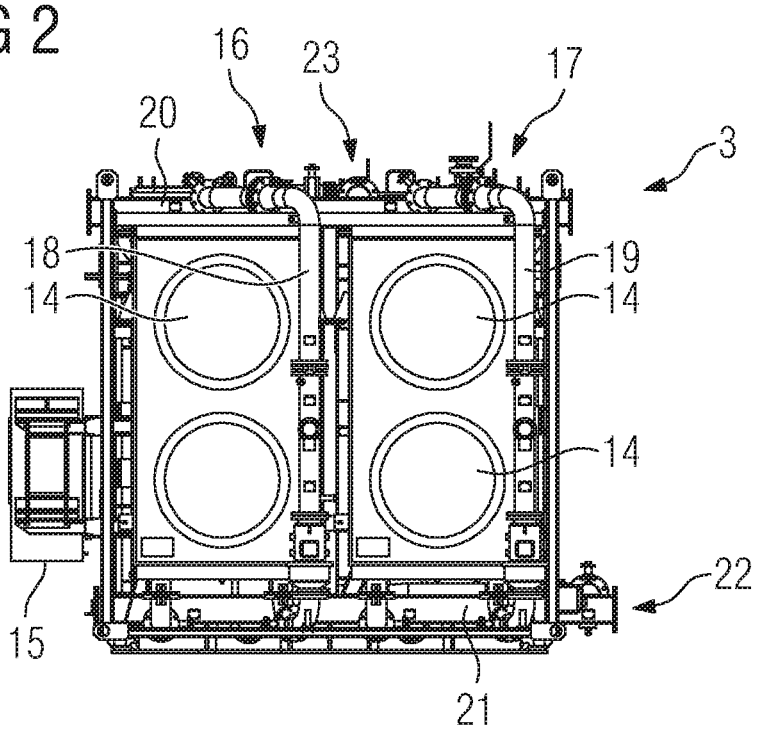
FIG. 2 shows a cooling module of the electrical appliance as per FIG. 1 in a front view.

FIG. 2 shows the cooling module 3 from the front. It can be seen that the cooling module 3 is equipped with fans 14 which, in terms of their rotational speed, can be accelerated, slowed or stopped entirely, in a manner dependent on the required cooling power, by a controller 15. The cooling module 3 furthermore has two cooling branches 16 and 17 which are each equipped with a dedicated attachment pipeline 18 and 19 respectively. Here, the attachment pipelines 18 and 19 branch off from an upper manifold line 20, wherein said attachment pipelines are merged again in a lower manifold line 21. The lower manifold line 21 forms a cooling-liquid outlet 22 which is connected to a cooling-liquid inlet of the housing 2. Furthermore, a cooling-liquid inlet 23 for the cooling module 3 is provided in the upper region of said cooling module, via which cooling-liquid inlet the insulating liquid entering the cooling module 3 enters the upper manifold line 20 and can pass from there into the cooling branches 16 or 17.

The upper manifold line 20 furthermore has two further line branches (not visible in FIG. 2) which have a heat exchanger. Insulating liquid which passes into said line branches is conducted via the respective heat exchanger. Each heat exchanger is in heat-conducting contact with the air stream generated by the fans 14. By contrast, the insulating liquid conducted via the attachment lines 18 and 19 is not cooled by the fans 14. The splitting-up of the insulating liquid between the different flow paths of the cooling module 3 is performed by the controller 15.

Figure 3:
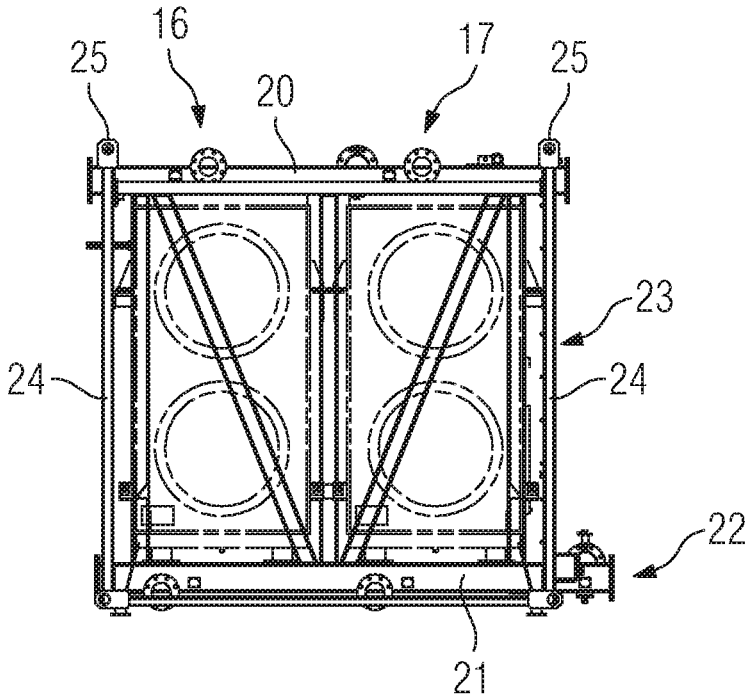
FIG. 3 shows the cooling module as per FIG. 2 without attachment pipes and in partially transparent form.

FIG. 3 shows the cooling module 3 likewise from the front, wherein, however, the attachment lines have been dismounted and the fans 14 and heat exchangers are shown in transparent form, such that a holding frame 23 can be seen. The holding frame 23 is assembled from longitudinal and transverse members and serves for holding the fans 14, the heat exchangers that are not illustrated in the figures, the cooling branches 16 and 17, and finally the manifold lines 20 and 21. On two longitudinal members 24 of the holding frame 23, in the upper region of the cooling module 3, there is formed in each case one lifting eyelet 25. The lifting eyelet 25 may for example be placed in engagement with a crane hook, such that the entire cooling module 3 can be lifted easily for the purposes of installing the electrical appliance 1. In FIG. 3, the openings in the upper manifold line 20 for the attachment lines 18 and 19 are illustrated, along with the counterparts thereof in the lower manifold line 21.

Figure 4:
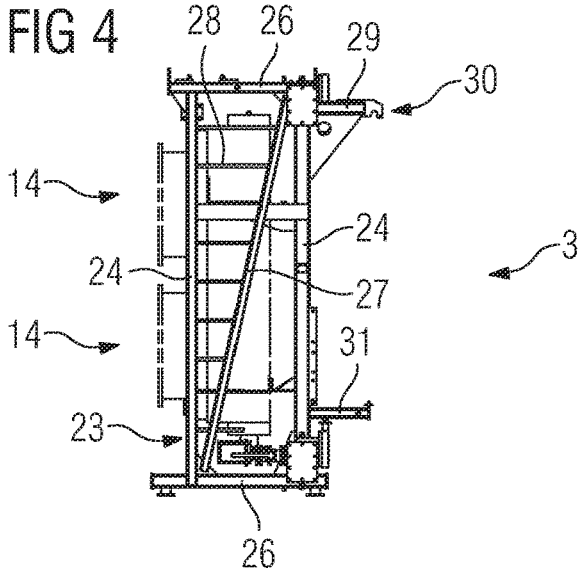
FIG. 4 shows the cooling module as per FIGS. 2 and 3 in a side view.

FIG. 4 shows the cooling module 3 as per FIG. 2 or 3 in a side view, which shows, in particular, the holding frame 23. The holding frame 23 has, on each side, both at the front and at the rear, in each case one longitudinal member 24. The two longitudinal members 24 are arranged parallel to one another and are connected to one another by way of an upper transverse member 26 and a lower transverse member 26. Furthermore, it is possible to see a stiffening element 27 which extends obliquely from the lower transverse member 26 to the upper transverse member 26 and which is connected to the rear longitudinal member 24 by way of reinforcement ribs 28. The reinforcement ribs 28 increase the mechanical strength of the holding frame 23 and furthermore form a climbing aid. The climbing aid 28 makes it easier for a user to climb onto the transformer 1, for example for maintenance purposes. The front longitudinal member 24 is equipped with a hook part 30 which has a carrier 29 extending in a longitudinal direction, the free end of which carrier is bent in a C shape. The hook part 30 can be placed in engagement with a counterpart 30*a* arranged on the housing 2, such that the entire cooling module 3 can, during the installation process, be fastened to the housing 2 in a simple manner by being hooked on.

In the lower region of the holding frame 23, it is possible to see a support element 31, which is fastened to the front longitudinal member 24 and which extends parallel to the carrier 29 of the hook part 30. After the C-shaped free end of the hook part 30 has been hooked onto the counterpart 30*a* fastened to the housing 2, the support element 31 bears by way of its free end against the outer wall of the housing 2 and holds the cooling module 3 in a position in which the front longitudinal member 24 runs substantially parallel to the side wall of the housing 2.

Figure 5:
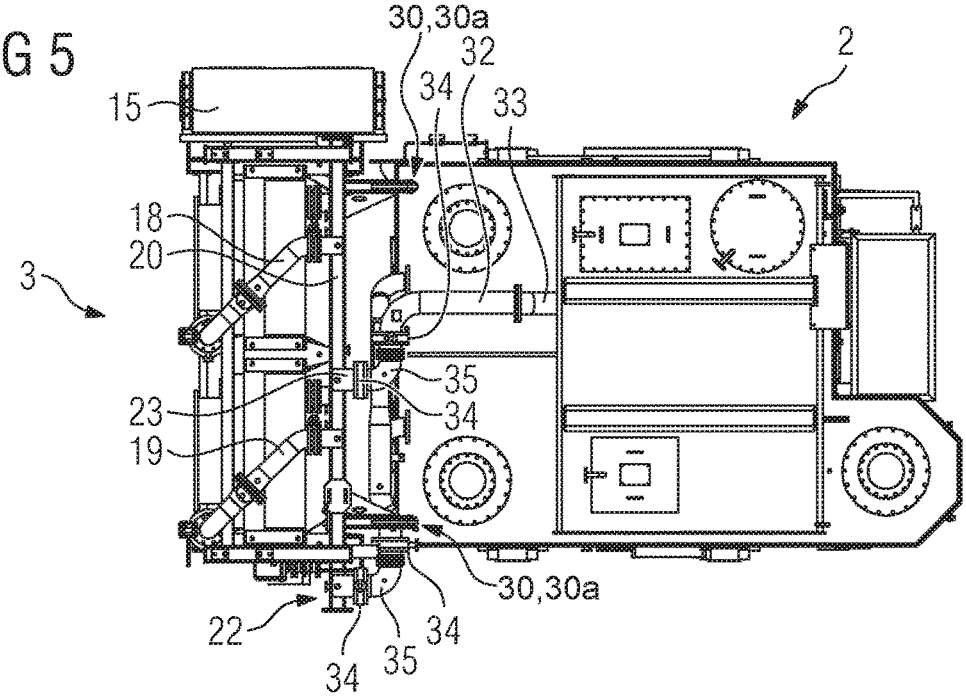
FIG. 5 shows the cooling module, hooked onto the housing, from above.

FIG. 5 shows the housing 2 with the hooked-on cooling module 3 in a plan view with installed attachment lines 18 and 19. In this position, it can be seen particularly clearly that the cooling liquid inlet 23 of the upper collecting line 20 is connected by way of an attachment line 32 to an inlet connector 33 of the housing 2. The attachment line 32 is connected in fluid-tight, that is to say air-tight and liquid-tight, fashion to the inlet connector 33 and has, in its front region, a closure valve 34. Furthermore, the cooling-liquid inlet 23 of the cooling module 3 is equipped with a closure valve 34. The attachment line 32 is in this case connected by way of an intermediate piece 35 to the cooling-liquid inlet 23 of the cooling module 3. In other words, the cooling-liquid outlet of the housing 2 is connected to the cooling-liquid inlet 23 via the intermediate piece 35. Correspondingly, the cooling-liquid outlet 22 in the lower region of the cooling module 3, which cooling-liquid outlet is likewise equipped with a closure valve 34, is connected by way of an intermediate piece 35 to a cooling-liquid inlet, which is likewise arranged in the lower region and equipped with a closure valve 34, of the housing 2.

Figure 6:
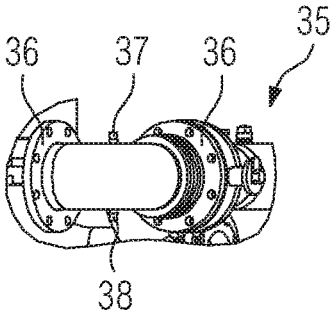
FIG. 6 shows an exemplary embodiment of an intermediate piece.

FIG. 6 shows said intermediate piece 35 in an enlarged illustration. It can be seen in particular that the intermediate piece 35 delimits a connecting duct which runs in curved fashion and which is open at both sides and which is connectable in fluid-tight fashion by way of a flange connection 36 to a cooling-liquid inlet and to a cooling-liquid outlet. For the ventilation of the connecting duct which extends between the two openings, a ventilation screw 37 is provided. By way of the ventilation screw 37, the connecting duct of the intermediate piece 35 can be ventilated. This is performed for example by applying a vacuum. The connecting duct can subsequently be filled with a gas, or else the closure valves 34 of the inlets and/or outlets can be carefully opened.

The intermediate piece 35 furthermore has a drainage screw 38 by way of which, during the dismounting process, insulating liquid can be targetedly drained from the connecting duct. After the draining of the insulating liquid, each intermediate piece 35 can be dismounted, and the cooling unit 3 can subsequently be separated from the housing 2.

The invention claimed is:

1. An electrical appliance for connection to a high-voltage grid, the electrical appliance comprising:

a housing to be filled with insulating liquid, and a core with at least one winding disposed in said housing;

a cooling module communicating with said housing via attachment lines, for cooling the insulating liquid; and a hook connection fastening said cooling module to said housing, said hook connection having a hook part fixedly connected to one of said cooling module or said housing and a counterpart fixedly mounted to the respectively other of said housing and said cooling module.

2. The electrical appliance according to claim 1, wherein said hook part is fixedly connected to said cooling module and said counterpart is fixedly mounted to said housing, and wherein said hook part and said counterpart are configured for engagement of said hook part into said counterpart.

3. The electrical appliance according to claim 2, wherein said housing has a cover, and said counterpart is arranged on said housing cover.

4. The electrical appliance according to claim 3, wherein said counterpart is one of at least two counterparts equally spaced apart from an edge of said housing.

5. The electrical appliance according to claim 2, wherein said hook part has a carrier that extends in a longitudinal direction and that has a free end which is bent in a C shape, and said counterpart is a holding bolt that extends parallel to and spaced apart from a wall of said housing.

6. The electrical appliance according to claim 1, wherein each of said housing and said cooling module has at least one cooling-liquid inlet and at least one cooling-liquid outlet that are connectable to one another for exchanging the insulating liquid, and wherein each said cooling-liquid outlet and each said cooling-liquid inlet is equipped with a fluid-tight closure valve.

7. The electrical appliance according to claim 6, which comprises an intermediate piece for a fluid-tight connection of said cooling-liquid outlet and said cooling-liquid inlet, said intermediate piece delimiting a connecting duct and having a ventilation opening for ventilating said connecting duct.

8. The electrical appliance according to claim 1, wherein said cooling module comprises a holding frame equipped with a hook part of said hook connection.

9. The electrical appliance according to claim 8, which further comprises an expansion tank fastened to said holding frame and communicating with an interior of said housing via a connection line.

10. The electrical appliance according to claim 1, wherein said cooling module comprises a holding frame equipped with a lifting engagement portion for lifting said holding frame.

11. The electrical appliance according to claim 10, which further comprises an expansion tank fastened to said holding frame and communicating with an interior of said housing via a connection line.

12. The electrical appliance according to claim 1, wherein said cooling module includes at least one fan.

13. An electrical appliance for connection to a high-voltage grid, the electrical appliance comprising:

a housing to be filled with insulating liquid, and a core with at least one winding disposed in said housing;

a cooling module communicating with said housing via attachment lines, for cooling the insulating liquid; and at least one hook disposed on one of said housing or said cooling module and at least one counterpart disposed on another of said cooling module or said housing, for releasable engagement between said at least one hook and said at least one counterpart and for connecting said cooling module to said housing by hanging said cooling module from said housing.

* * * * *